US006535095B2

(12) United States Patent
Aoki et al.

(10) Patent No.: US 6,535,095 B2
(45) Date of Patent: Mar. 18, 2003

(54) WOUND TYPE COMMON MODE CHOKE COIL

(75) Inventors: Hidenori Aoki, Tamamuramachi (JP); Manabu Takayama, Maebashi (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/836,206

(22) Filed: Apr. 18, 2001

(65) Prior Publication Data

US 2001/0038327 A1 Nov. 8, 2001

(30) Foreign Application Priority Data

Apr. 18, 2000 (JP) ..... 2000-117003
Sep. 14, 2000 (JP) ..... 2000-280677

(51) Int. Cl.[7] ..... H01F 5/00

(52) U.S. Cl. ..... 336/83; 336/200; 336/223; 336/232

(58) Field of Search ..... 336/83, 200, 212, 336/90, 96, 223, 232

(56) References Cited

U.S. PATENT DOCUMENTS 6,154,112 A * 11/2000 Aoba et al. ..... 336/112
6,157,283 A * 12/2000 Tsunemi ..... 336/192
6,252,481 B1 * 6/2001 Iwao et al. ..... 336/83
6,362,715 B1 * 3/2002 Chiang et al. ..... 336/198
6,373,366 B1 * 4/2002 Sato et al. ..... 336/192
6,388,550 B1 * 5/2002 Kanetaka et al. ..... 336/223

* cited by examiner

*Primary Examiner*—Anh Mai
(74) *Attorney, Agent, or Firm*—Townsend & Banta

(57) ABSTRACT

A wound type common mode choke coil resulting in a tip shape finished product is provided, having a good appearance, high reliability, and excellent common mode characteristics, by reducing the profile of the common mode component. This wound type common mode choke coil has a magnetic core with square collar portions at both ends of a winding core, grooves in the square collars, first electrodes, a pair of coil conductors wound around the winding core portion connected conductively to the first electrode layers of the collar portions, a non-magnetic first insulation coating layer coating the outer circumference of the magnetic core, a second insulation coating layer containing magnetic power armor-coated to the whole outer circumference of the common mode choke coil, and second electrode layers coating from the groove portions over the first electrode layers. The groove portions prevent the excess resin produced during the sealing from flowing over and degrading other elements of the device by allowing drainage therethrough.

4 Claims, 10 Drawing Sheets

WOUND TYPE COMMON MODE CHOKE COIL

FIELD OF THE INVENTION

The present invention relates to a wound type common mode choke coil used for various electronic equipment.

BACKGROUND OF THE INVENTION

Conventionally, wound type common mode choke coils have been used in electronics, having a plurality of electrode layers disposed separately around the circumferential surface of one or both collar portions of a magnetic core, a pair of coil conductors wound around the winding core portion of said magnetic core by bifilar winding or the like, each terminal being conductively connected to each electrode layer of the collar portion by soldering, heat press fitting or the like and, further, the outer circumference of the wound coil conductor being coated with insulation coating layer.

In addition, a substantially closed magnetic circuit structure is commonly used having a winding around a coil conductor and a plate magnetic core coupling placed between both collar portions of the magnetic core as magnetic shield. Gluing with adhesive is used to adhere the plate magnetic core on the circumferential surfaces of both collar portions to reduce leak magnetic flux and improve the impedance characteristics.

In previous vertical disposition type wound type common mode choke coils, four terminal electrodes are disposed at predetermined intervals from the circumferential surface of the collar portion at the bottom side to the end face, i.e., where vertical mounting of the winding core portion of the magnetic core is desired. In horizontal disposition type choke coils, the four terminal electrodes are generally separately disposed two by two at both collar portions where the winding core portion of the magnetic core is parallel to the mounting substrate.

As mentioned above, there are both vertical disposition type, and horizontal disposition type devices (for vertical and horizontal mounting) for the winding core portion of the wound type common mode choke coil of the prior art, the horizontal disposition type being preferable when desiring reduction of the substrate mounting height. In this respect, the structure wherein the magnetic shield is obtained by adding the aforementioned plate magnetic core between the collar portions of the magnetic core is increased in height by the thickness of the plate magnetic core plate, so that the structure is undesirable when desiring a reduction in the height of the component mounted on a substrate.

From the viewpoint of ease of handling during the mounting process on the substrate, as well as reliability, a rectangular parallelepiped shaped tip shape wherein the insulation coating layer is armored to the outer circumference of the coil in such a way as to fill a concave area between both collar portions according to the square shape of the collar portion, is undesirable.

In addition, with conventional common mode choke coils, it is necessary to improve the common mode impedance characteristics through an enhanced binding by densely winding a pair of coil conductors by, for instance, bifilar winding, and at the same time, to possibly decrease the normal mode impedance. In this respect, it is preferable to armor the entire outer circumference of the pair of coil conductors wound around the winding core portion with a non-magnetic insulation coating layer for reducing the normal mode impedance. In contrast, with respect to reducing the leak magnetic flux due to the magnetic shield, it is preferable to obtain a closed magnetic circuit structure by coupling both collar portions of the choke coil with a magnetic body, wherein a substantially closed magnetic circuit structure is formed.

Further, with conventional devices, in a resin sealing process of the insulation coating layer, problems arise concerning appearance and reliability, as an excess of the resin armored to the outer circumference of the coil inevitably flows over the circumferential surface or end face of the collar portion form burr. This exposed burr is undesirable from the viewpoint of appearance, and must be removed by barrel polishing. However, during barrel polishing, a portion of the device from the outer circumference of the coil conductor to the conductive connection portion between respective terminals of the coil conductor and the electrode layer may be exposed, and the exposed portion may be easily damaged.

SUMMARY OF THE INVENTION

It is an object of the present invention to solve the aforementioned problems found in the conventional wound type common mode choke coils, and to improve the quality (reliability, characteristics, appearance, and the like) thereof.

In order to solve the above aforementioned problems, the present invention provides, in a first embodiment, a wound type common mode choke coil having a magnetic core, the magnetic core having a winding core with two ends and a square collar portion disposed respectively at each of the ends of the winding core, a circumferential surface on each collar portion, a groove portion disposed around the circumferential surface of each collar portion from the winding core side to the end face side of the collar portion;

- a plurality of first electrode layers disposed separately at least around the circumferential surface of each collar portion of the magnetic core;
- a pair of coil conductors wound around the winding core portion of the magnetic core, each of whose respective terminals are respectively conductively connected to the first electrode layer of each collar portion;
- a non-magnetic first insulation coating layer disposed so as to integrally coat the outer circumference of the pair of coil conductors wound around the winding core portion of the magnetic core;
- a second insulation coating layer armored/coated on the whole outer circumference of the first insulation coating layer, the second insulation coating layer containing magnetic powder of the winding core portion, and disposed according to the square shape of the collar portion from a concave area located between both collar portions to the groove portion of each collar portion of the magnetic core; and
- a second electrode layer coating from the groove portion on which the second insulation coating layer of the circumferential surface of each collar portion of the magnetic core is disposed to the first electrode layer. Further to the first embodiment of the wound type common mode choke coil, of the first embodiment of the present invention above, the conductive connection portion of respective terminals of the pair of coil conductors and the first electrode layer is disposed in the groove portion on the circumferential surface of the collar portion.

In a second embodiment of the present invention, a wound type common mode choke coil is provided, wherein the first insulation coating layer coats from the outer circumference of the pair of coil conductors wound around the winding core portion of the magnetic core to the conductive connection portion E of respective terminals of the coil conductors and the first electrode layer.

BRIEF DESCRIPTION OF THE DRAWINGS

FIG. 4(*b*) is a longitudinal cross-sectional view of the wound type common mode choke coil showing FIG. 4(*a*) taken along line A-A.

FIG. 11(*b*) is a cross-sectional view vertical to the winding core 1 of the wound type common mode choke coil 70 of the present invention.

DETAILED DESCRIPTION OF THE INVENTION

Figure 2:
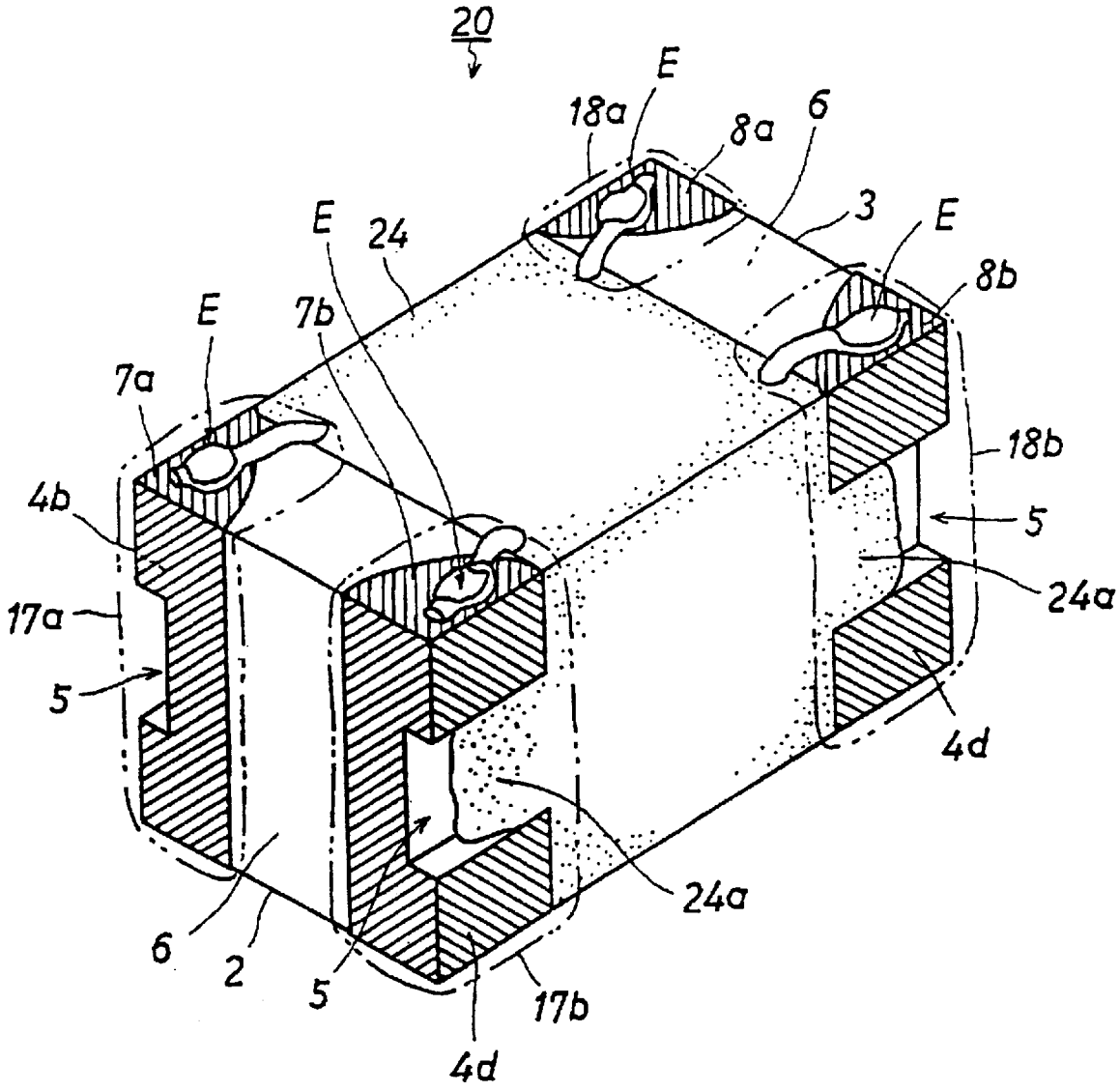
FIG. 2 is a perspective view of the first embodiment of the present invention, showing a state after coating of a second insulation coating layer on the wound type common mode choke coil.
Figure 3:
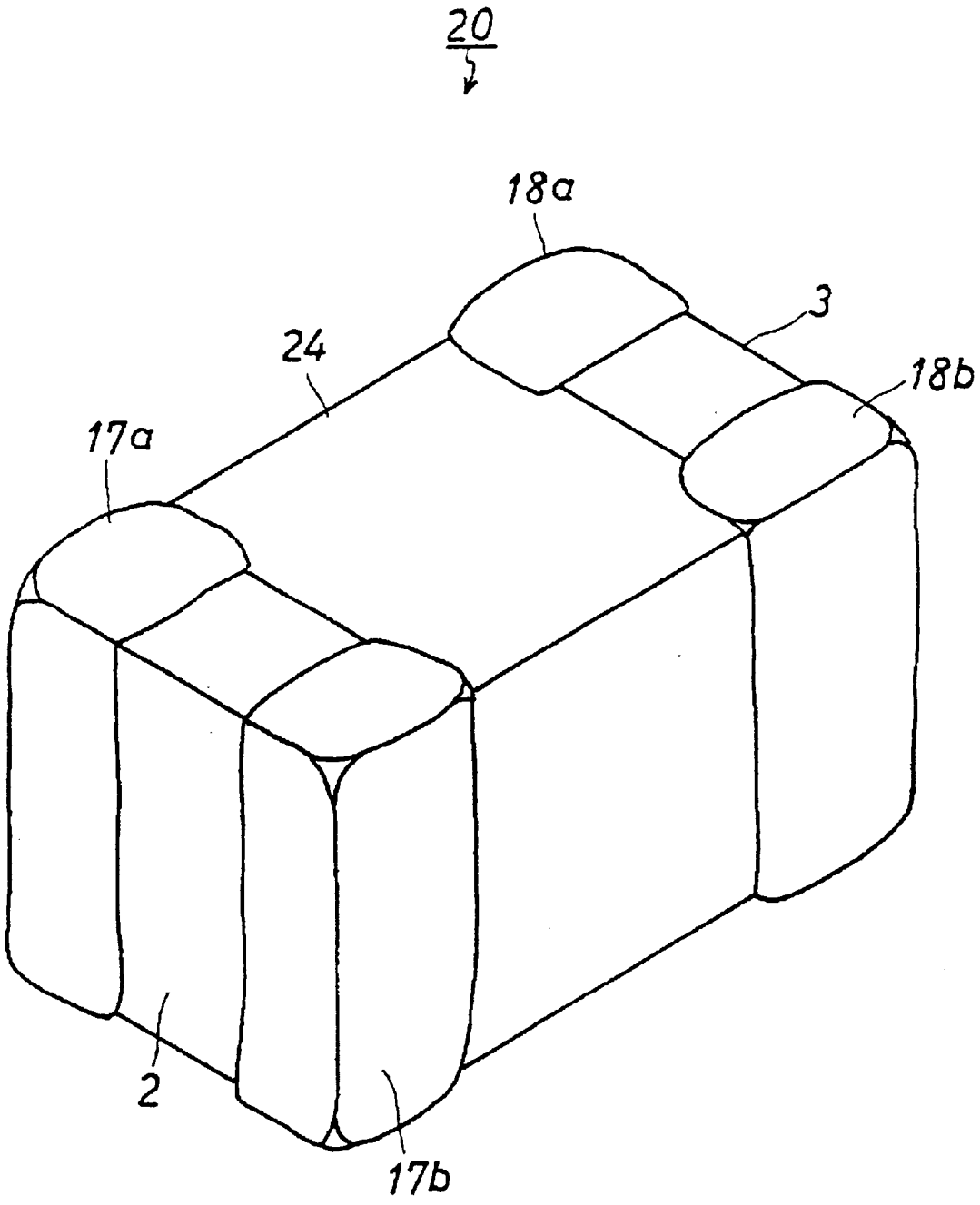
FIG. 3 is a perspective view of the finished wound type common mode choke coil according to the first embodiment of the present invention.
Figure 4A:
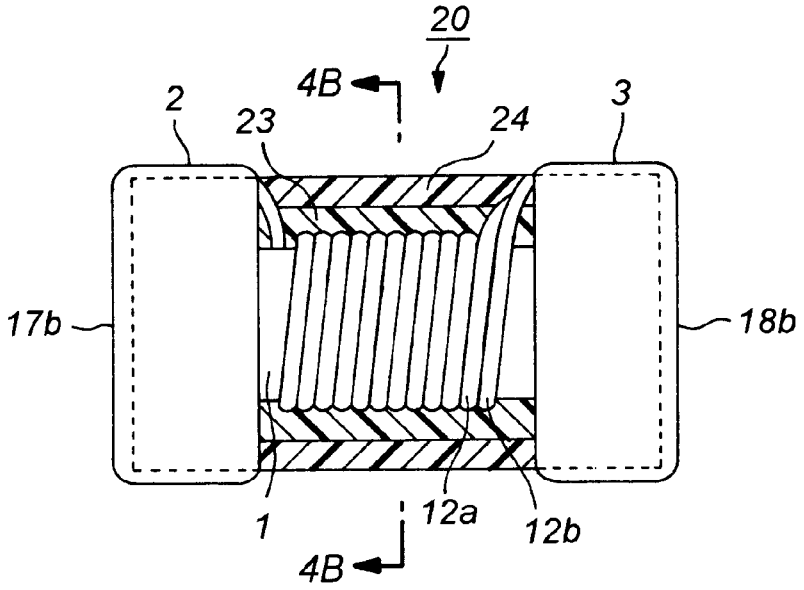
FIG. 4(*a*) is a cross sectional side view of the wound type common choke coil of the first embodiment of the present invention.
Figure 4B:
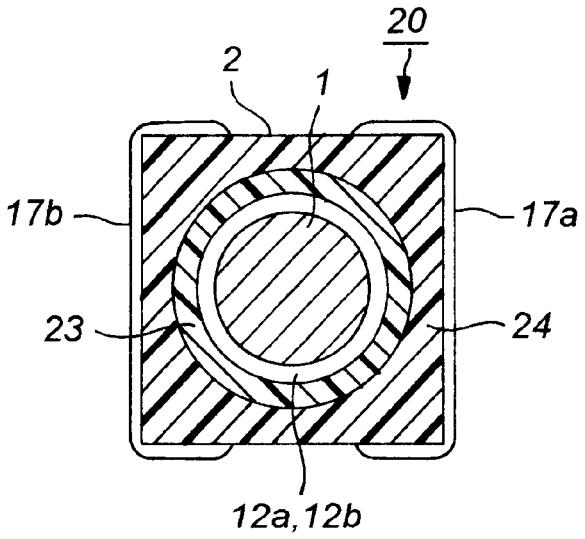

A wound type common mode choke coil 20, as shown in FIG. 1 to FIG. 4(*b*), comprises a magnetic core 10 having square collar portions 2, 3 respectively at both ends of a winding core 1 and groove portions 5 disposed the circumferential surfaces 4*b*, 4*d* of respective collar portions 2, 3 from the winding core portion 1 side to the end face 6 side of the collar portions 2, 3. A plurality of first electrode layers 7*a*, 7*b*, 8*a*, 8*b* are disposed respectively separately at least around the circumferential surface 4*a* of each of collar portions 2, 3 of the magnetic core 10. A pair of coil conductors 12*a*, 12*b* are wound around the winding core portion 1 of the magnetic core 10, their respective terminals being conductively connected to the first electrode layers 7*a*, 7*b*, 8*a*, 8*b* of the collar portions 2, 3. A non-magnetic first insulation coating layer 23, as shown in FIGS. 4(*a*) and 4(*b*), is disposed so as to integrally coat the outer circumference of the pair of coil conductors 12*a*, 12*b* wound around the winding core portion 1 of the magnetic core 10. A second insulation coating layer 24 armor/coated on the whole outer circumference of the first insulation coating layer 23 contains magnetic powder made from the same material of the winding core portion 1, and is formed in the square shape as that of the collar portions 2, 3 and is disposed from a concave area between both collar portions 2, 3 to the groove portion 5 of each of collar portions 2, 3 of the magnetic core 10. Second electrode layers 17*a*, 17*b*, 18*a*, 18*b* (shown by two-dot-chain line in FIG. 2) are disposed so as to form a coating from the groove portion 5 on which the second insulation coating layer 24 of the circumferential surface 4*b*, 4*d* of the respective collar portions 2, 3 of the magnetic core 10 is disposed to the first electrode layers 7*a*, 7*b*, 8*a*, 8*b*. The completed wound type common mode choke coil 20 of the present invention is vertically symmetric and may be mounted horizontally on a substrate so that the second electrode layers 17*a*, 17*b*, 18*a*, 18*b* around the lower circumferential surface of the collar portions 2, 3 come into contact, for instance, with the mounting substrate (not shown) at the bottom of the drawing, and is connected and fixed respectively by solder reflowing or the like.

The magnetic core 10 is made, for instance, of a resin mold mixed with ferrite and magnetic powder or ceramics such as alumina mixed with magnetic powder. The conductive coating film of the first electrode layers 7*a*, 7*b*, 8*a*, 8*b*, made of silver, silver-platinum or copper, with solder layer or the like deposited thereon, is formed by plating or dipping both end sides of both collar portions 2 and 3 and at least one circumferential surface 4*a* where the groove portion 5 is not formed.

Figure 1:
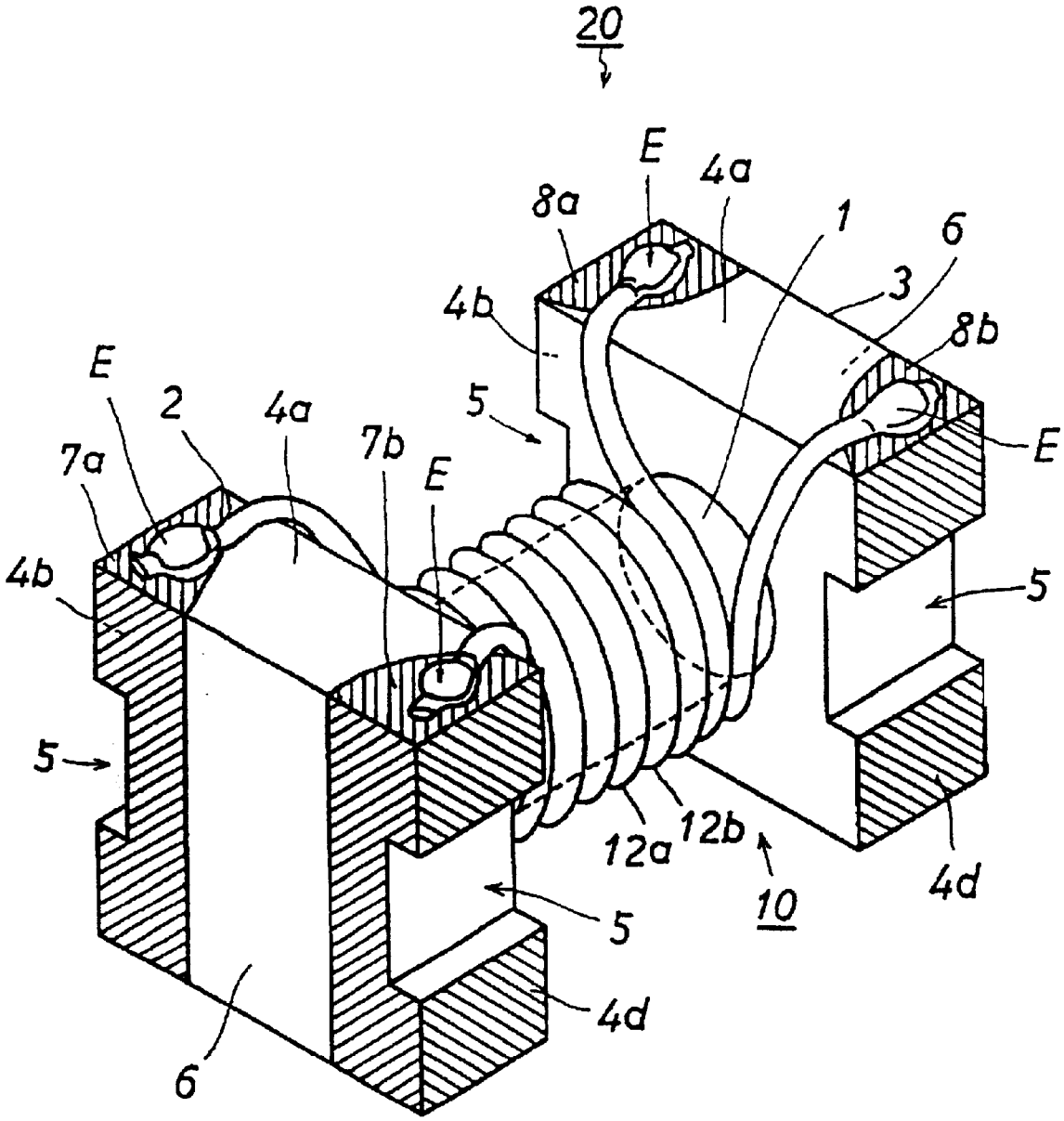
FIG. 1 is a perspective view of the first embodiment of the present invention, showing a state of the device before coating of a first insulation coating layer is applied on the wound type common mode choke coil.

The respective terminals of the coil conductors 12*a*, 12*b* are joined with the first electrode layers 7*a*, 7*b*, 8*a*, 8*b* at a conductive connection portion E respectively by welding, heat press fitting or ultrasonic vibration. In heat press fitting, the terminal of an insulation coating lead wire constituting the coil conductor is pressed on the first electrode layers 7*a*, 7*b*, 8*a*, 8*b* by a heated head to deform and flatten the terminals, as shown in FIG. 1, and is diffused and joined with the first electrode layers 7*a*, 7*b*, 8*a*, 8*b*. In ultrasonic vibration, the insulation coating of the respective terminals is removed by the head vibration, and the resulting cleaned copper wire and the first electrode layers 7*a*, 7*b*, 8*a*, 8*b* are joined by pressing a heated head. When the pair of coil conductors 12*a*, 12*b* are connected to a circuit of various electronic equipment, the winding start terminal thereof is connected to the power supply side and the winding end terminal is connected to the electronic equipment circuit side. In such a configuration, an integrated coil unit appropriate for bifilar winding is preferable.

A thermosetting resin, such as epoxy resin or the like, is used for the non-magnetic first insulation coating layer 23. Epoxy resin blended with 50–90 wt % ferrite powder or other magnetic powder is used for the second insulation coating layer 24 containing magnetic powder. In the aforementioned wound type common mode choke coil 20, as shown in FIG. 2, the groove portions formed on the circumferential surfaces 4*b*, 4*d* of the square shaped collar portions 2, 3 serve as clearance grooves for drainage of excessive resin 24*a* of the second insulation coating layer 24 during the sealing process. In addition, the groove portions (clearance grooves) provide a functional effect of preventing the excess resin 24*a* from flowing into other areas of the circumferential surfaces of the square shaped collar portions 2, 3. For example, in the wound type common mode choke coil 20 of FIG. 1 and FIG. 2, first electrode layers 7*a*, 7*b*, 8*a*, 8*b* are formed separately at both edge end sides of collars 2 and 3 in contact with adjacent circumferential surfaces 4*b*, 4*d* on at least one circumferential surface 4*a*, where the groove portion 5 is not formed on the collar portions 2, 3, and respective terminals of the coil conductors 12*a*, 12*b* are conductively connected at (point of conductive connection) portion E. Therefore, the excess resin 24*a* is prevented from flowing into the conductive connection portion E of the first electrode layers 7*a*, 7*b*, 8*a*, 8*b* and the respective terminals of the pair of coil conductors 12*a*, 12*b*, thus reducing the possibility of peeling off or wire breaking due to coating therein of excess resin 24*a* into the conductive connection portion E, and allowing the structure provided with this groove portion 5 to have a reliable conductive connection portion E.

In addition, the excess resin 24*a* flowing into the groove portion 5 is covered and buried within the second electrode layers 17*a*, 17*b*, 18*a*, 18*b* with the groove portion 5, and thus the excess resin 24*a* is not exposed as undesirable burr. The second electrode layers 17*a*, 17*b*, 18*a*, 18*b* cover and encase an area from the first electrode layers 7*a*, 7*b*, 8*a*, 8*b* and the pair of coil conductors 12*a*, 12*b* to the conductive connection portion E, to provide a tip shaped common mode choke coil having a desirable appearance, with no distinction between the top and the bottom, and which is easy to handle, as shown in FIG. 4.

Figure 5:
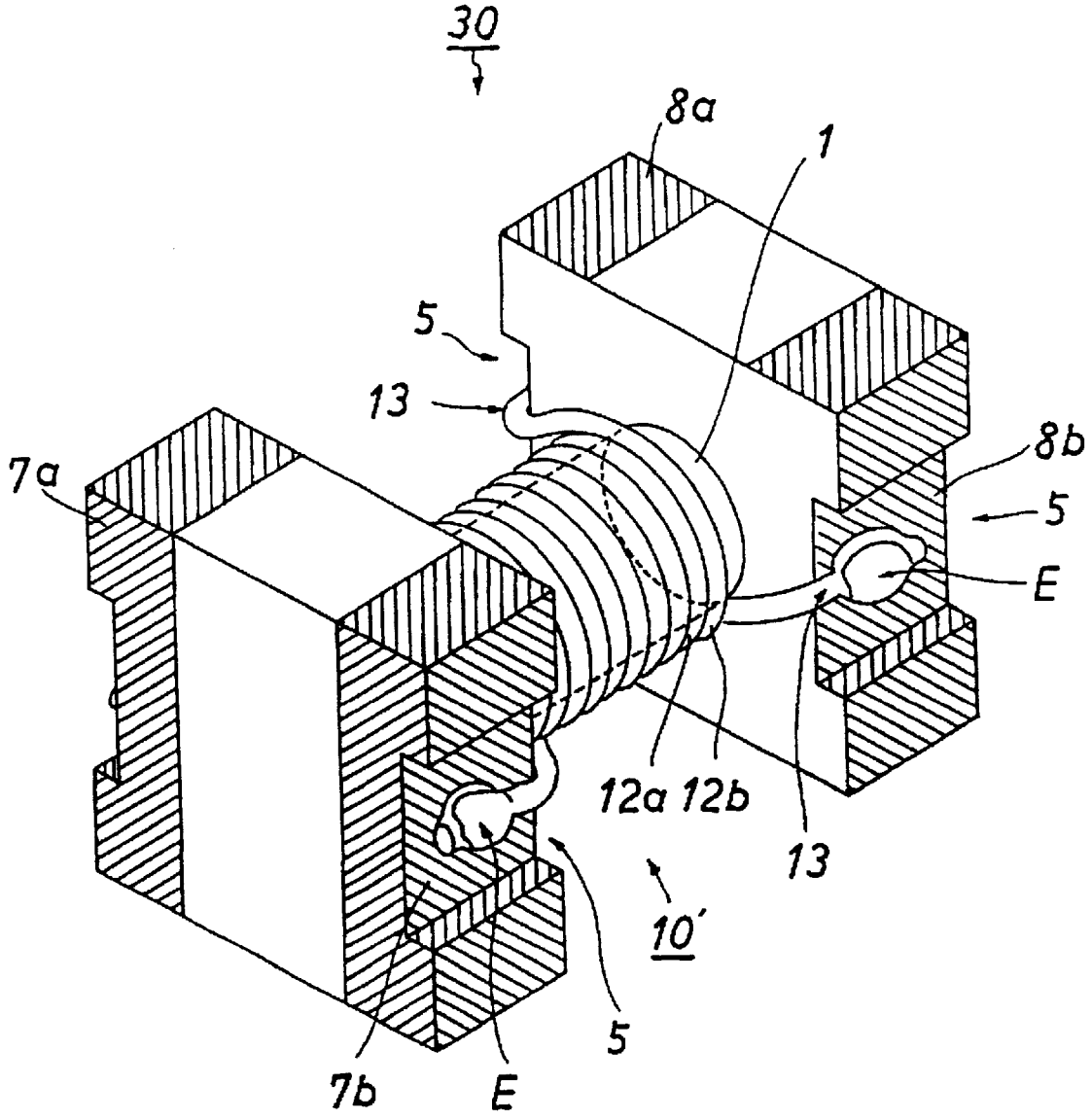
FIG. 5 is a perspective view of the wound type common choke coil according to a second embodiment of the present invention, showing the state of the device before coating of a first insulation coating layer.

In the second embodiment of the wound type common mode choke coil 30 of the present invention, as shown in FIG. 5, the shape of the magnetic core 10' is substantially similar to the magnetic coil 10 of the wound type common mode choke coil 20 according to the first embodiment. However, the first electrode layers 7*a*, 7*b*, 8*a*, 8*b* are also formed in the groove portions 5, and, moreover, respective terminals of the pair of coil conductors 12*a*, 12*b* are conductively connected within the groove portion 5 (i.e., the conductive connection portion E exists in the groove portion 5).

Figure 6:
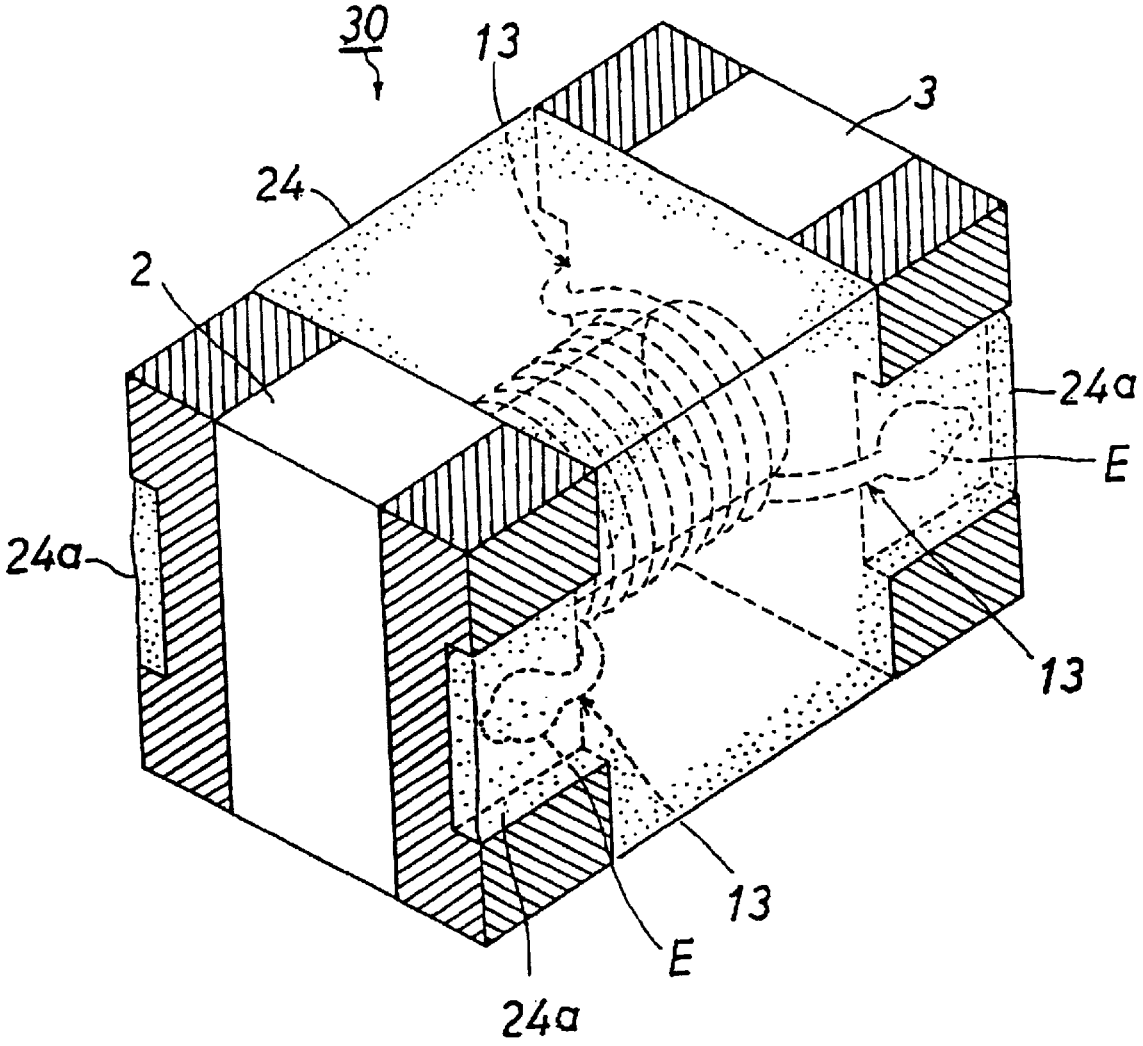
FIG. 6 is a perspective view of the wound type common mode choke coil according to the second embodiment of the present invention, showing the state of the device after coating of a second insulation coating layer.

Therefore, as shown in FIG. 6, the excess resin 24*a* of second insulation coating layer 24 containing magnetic powder, disposed in conformity with the square shape of the collar portions 2, 3 from the concave area between both collar portions 2, 3 of the magnetic core 10 to the groove portions 5, flows into the groove portions 5 of the collar portions 2, 3, to cover the conductive connection portions E in such a way as to fill same. In addition, the excess resin 24*a* protruding out from the collar portions 2, 3 as burr is removed by barrel polishing. During barrel polishing, the conductive connection portions E and the lead wire portions 13 of the coil conductors 12*a*, 12*b* leading thereto are disposed within the groove portions 5, and are thus protected from damage during the barrel polishing by the excess resin 24*a* filling the groove portions 5. Thus, reliability of the structure according to the second embodiment is very high.

Figure 7:
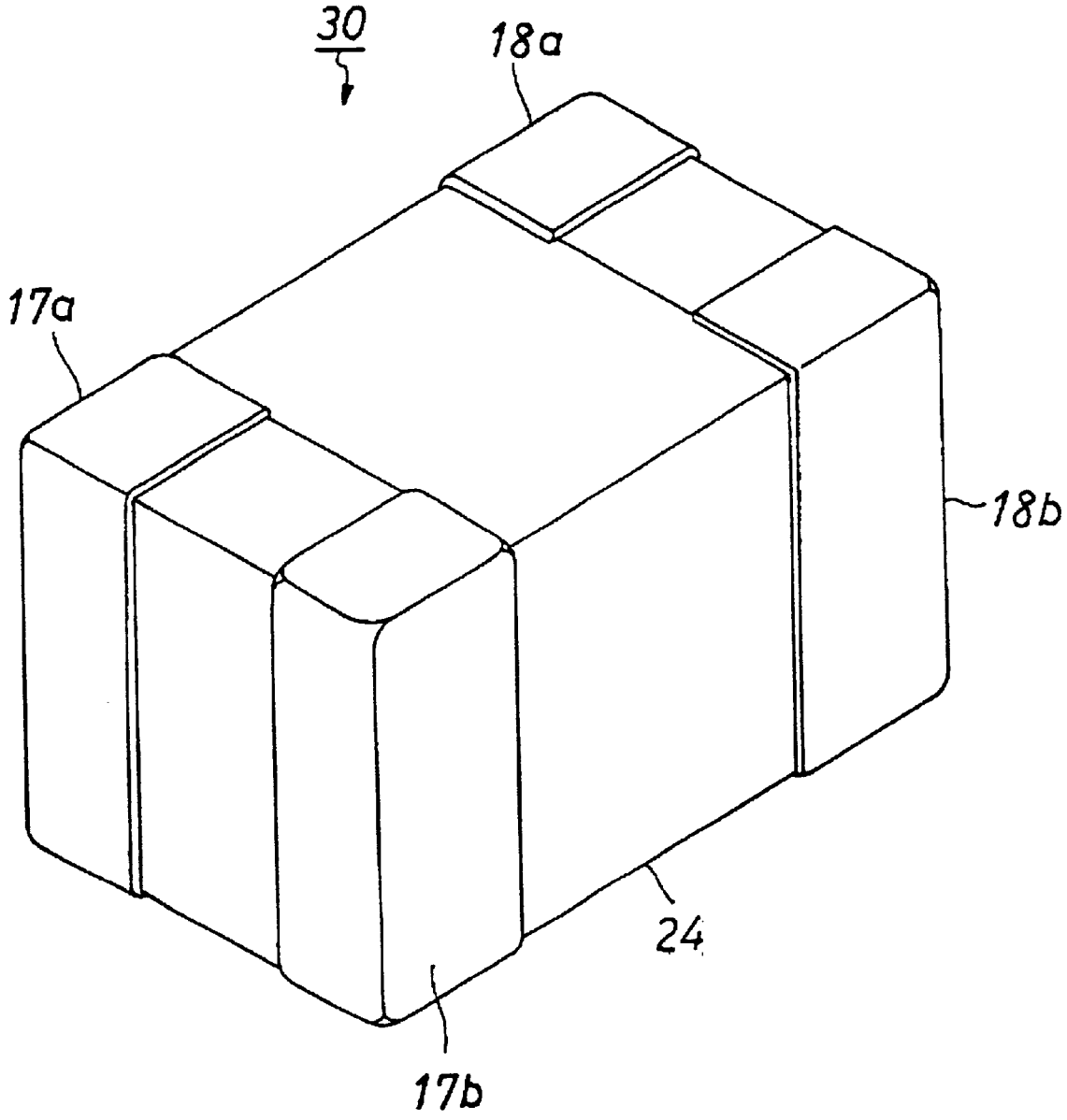
FIG. 7 is a perspective view of the finished wound type common mode choke coil of the second embodiment.

Moreover, in the wound type common mode choke coil 20 according to the first embodiment, the conductive connection portions E are formed at the first electrode layers 7*a*, 7*b*, 8*a*, 8*b* on the circumferential surfaces 4*a* (top face in the perspective view of FIG. 1) of the collar portions 2, 3, and are exposed on the collar portion 2, 3. Thus, the second electrode layers 17*a*, 17*b*, 18*a*, 18*b* should be formed thick enough on the first electrode layers 7*a*, 7*b*, 8*a*, 8*b* to cover the conductive connection portions E, making it relatively difficult to standardize the appearance of the finished product. In contrast, in the wound type common mode choke coil 30 according to the second embodiment, the conductive connection portion E is disposed within the groove portions 5, and covered with the excess resin 24*a*. Therefore, as shown in FIG. 7, the finished product of the second embodiment, even if the second electrode layers 17*a*, 17*b*, 18*a*, 18*b* are relatively thin, the layers can cover the first electrode layers 7*a*, 7*b*, 8*a*, 8*b* and the conductive connection portions E, together with the excess resin in the groove portions 5, allowing advantageously to stabilize the appearance shape of the finished product.

Figure 8A:
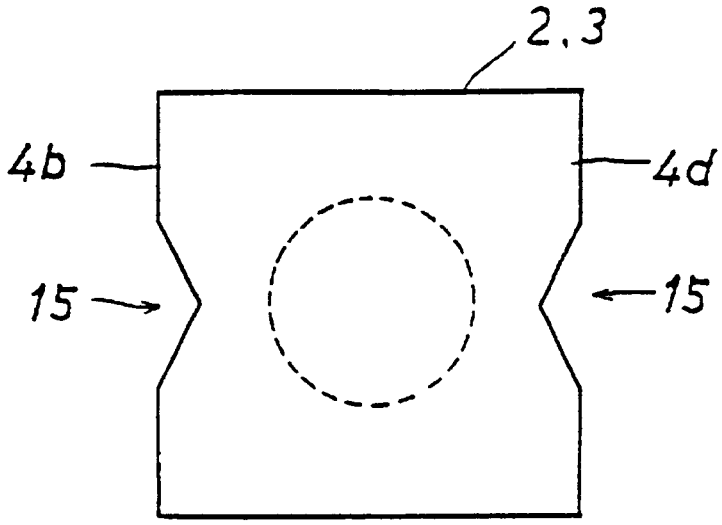
FIG. 8 is a longitudinal cross-sectional view of a device having a V-groove shaped groove portion.
Figure 8B:
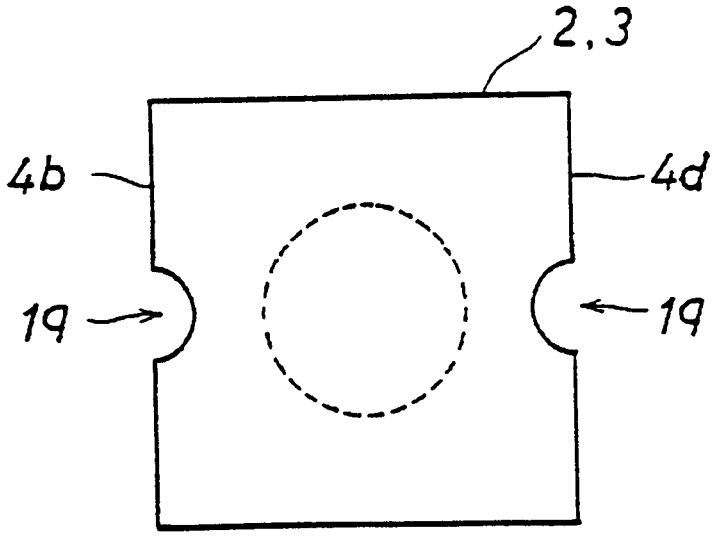
Figure 9:
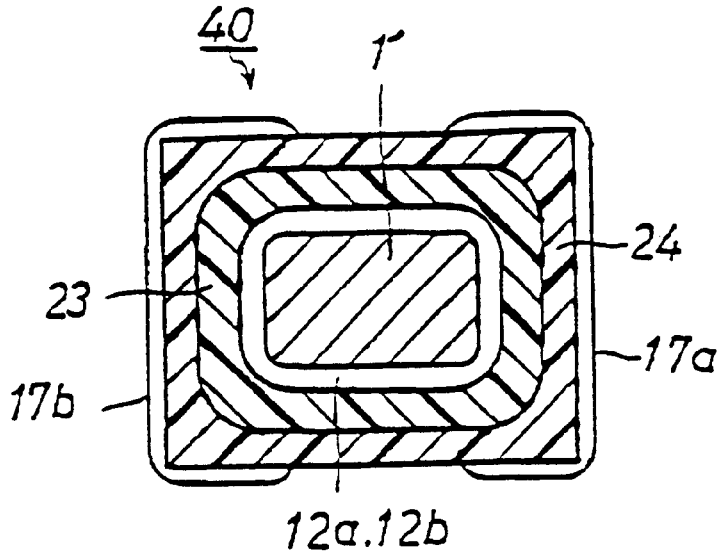
FIG. 9 is a longitudinal cross-sectional view of the wound type common mode choke coil of the present invention, having a hemispheric groove portion.
Figure 10:
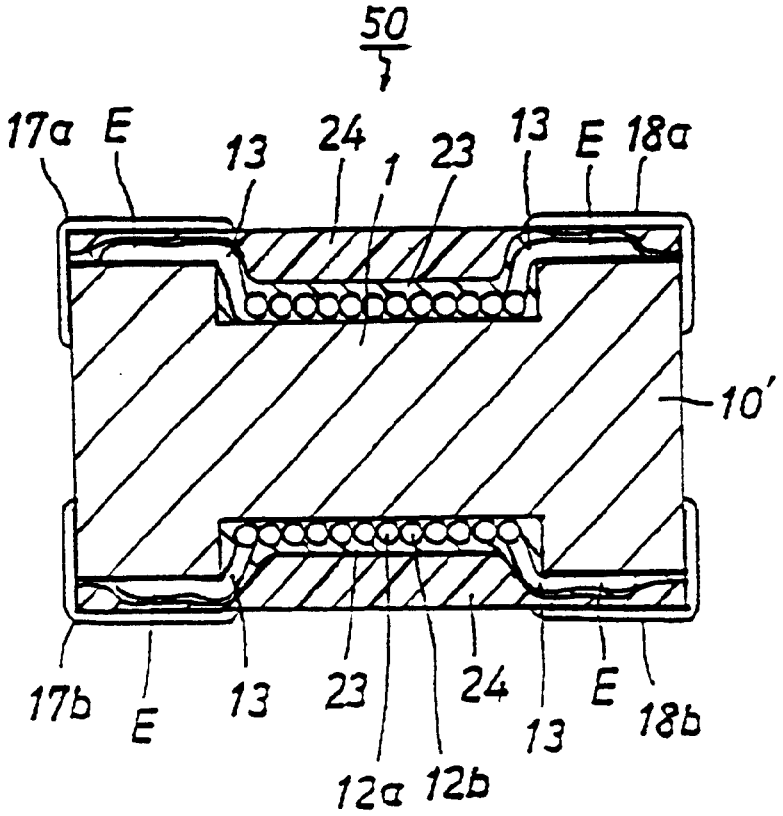
FIG. 10 is a longitudinal cross-sectional view showing the configuration of insulation coating layer armored to the outer circumferential surface of the pair of coil conductors 12*a*, 12*b* in a wound type common mode choke coil 50 according to a third embodiment of the present invention.
Figure 11A:
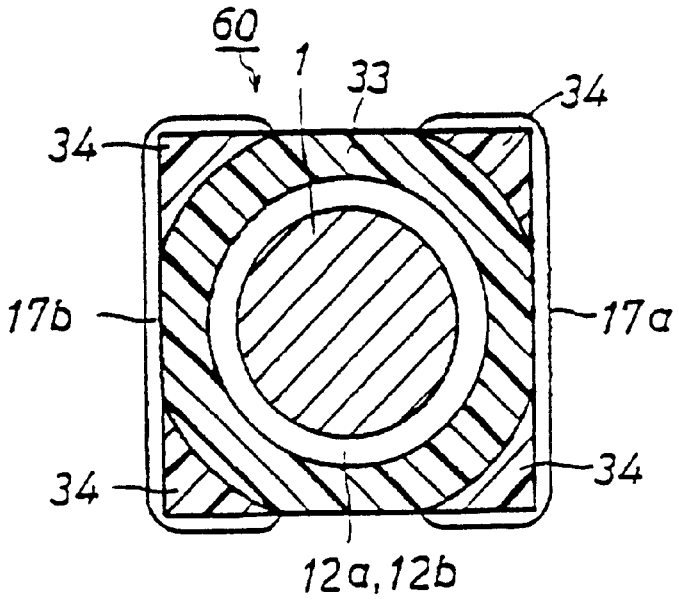
FIG. 11(*a*) is a cross-sectional view vertical to the winding core 1 of wound type common mode choke coils 60 and 70 of the other embodiments of the present invention.
Figure 11B:
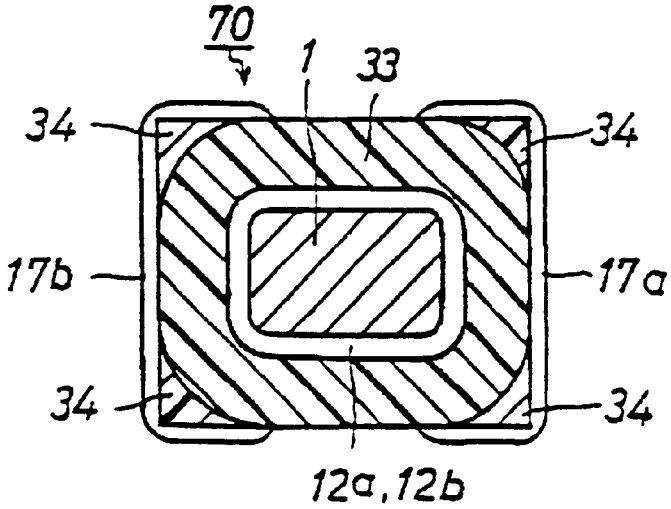

The cross section of the groove portions 5 disposed on the circumferential surfaces 4*b*, 4*d* of the collar portions 2, 3 in both wound type common mode choke coils 20, 30 are not limited to a rectangular concave groove, as shown in FIG. 1 or FIG. 5 but can also be V-groove shaped groove portions 15, as shown in the longitudinal front view of FIG. 8(*a*), or hemispheric groove portions 19, as shown in FIG. 8(*b*). The shape of the winding core portion 1 of the magnetic cores 10, 10' is not limited to the cylindrical shape as shown in FIG. 1, but may be a rectangular winding core portion 1' as shown in the rectangular longitudinal cross section of a wound type common mode choke coil 40 of FIG. 9, without changing the double sealing structure of the non-magnetic first insulation coating layer 23 and the second insulation coating layer 24 containing magnetic powder.

The wound type common mode choke coil 50 is characterized by a structure wherein, especially, the non-magnetic first insulation coating layer 23 mentioned in the aforementioned embodiment is covered from the outer circumference of the pair of coil conductors 12*a*, 12*b* wound around the winding core portion 1 of the magnetic core 10' to the conductive connection portion E between respective terminals of the coil conductor and the first electrode layers 7*a*, 7*b*, 8*a*, 8*b*. In other words, in this type of structure, the lead wire portion 13 is also covered with the non-magnetic first insulation coating layer 23, further decreasing the normal mode impedance component in the lead wire portion 13, thereby improving common mode choke coil characteristics.

In the common mode choke coil of the present invention, the double insulation layer covering structure as mentioned above allows a decrease in height by removing the need for a conventional plate shaped magnetic core to be placed between the collar portions 2, 3 of the magnetic core 10, reduces the normal mode impedance component by the non-magnetic first insulation coating layer 23, and reduces the leak magnetic flux through realization of a complete closed magnetic circuit structure due to the presence of the second insulation coating layer 24 containing magnetic powder. Moreover, it is advantageous that the gap between the pair of coil conductors 12*a*, 12*b* and the second insulation coating layer 24, acting as magnetic shield material, can be easily controlled by adjusting the thickness of the non-magnetic first insulation coating layer 23.

The configuration of the aforementioned wound type common mode choke coils 60, 70 comprises a non-magnetic first insulation coating layer 33 armor coated on the coil conductors 12*a*, 12*b*, which does not protrude from the concave area between the collar portions 2, 3 of the magnetic core 1, nor extend beyond a straight line drawn from the angle corners of the collar portions 2, 3 to each other, in case of relatively thick winding core 1 according to the progress of further miniaturization. Or, in the case of thicker coil conductors 12*a*, 12*b* and smaller concave area for disposing the second insulation coating layer, a second insulation coating layer 34 may be disposed in accordance with the square shape of the collar portions 2, 3 on the outer circumference of the first insulation coating layer 33 and in the area of the edge line portion, reducing the normal mode impedance component by reducing the height of the non-magnetic first insulation coating layer 33 integrally armor-coated over the outer circumference of the coil conductors 12*a*, 12*b*. In addition, such an embodiment reduces the leak magnetic flux by magnetic shielding through realization of a closed magnetic circuit structure with second insulation coating layer 24 coupling between both collar portions 2, 3. In this case, the second insulation coating layer 34 is disposed here, taking advantage of a vacant area of the first insulation coating layer 33 that can be formed by the edge line portion connecting four angle corners having the maximum thickness of the concave area of the square shaped collar portions 2, 3 and the winding core portion 1.

As mentioned above, the wound type common mode choke coils 20, 30, 30, 40, 50, 60, 70 according to the present invention are both of winding core horizontal disposition type, and have a structure wherein the concave area between both collar portions 2, 3 of the magnetic core 10 or 10' is armor-coated with the non-magnetic first insulation coating layer 23 or 33 and the second insulation coating layer 24 or 34 containing magnetic powder in such a way as to cover the outer circumference of the coil conductors 12*a*, 12*b* and fill the concave area according the square shaped collar portions. The terminal electrodes have a double layered structure including the first electrode layers 7*a*, 7*b*, 8*a*, 8*b* conductively connected with respective terminals of the coil conductors 12*a*, 12*b*, and the second electrode layers 17*a*, 17*b*, 18*a*, 18*b* formed to cover the first electrode layers 7*a*, 7*b*, 8*a*, 8*b* after armor-coating the second insulation coating layer 24 or 34, providing a finished product having a substantially rectangular parallelepiped shaped tip form, as shown in FIG. 3 or FIG. 7, which is appropriate for a high density automatic mounting. Such a configuration provides a coil component excellent in common mode characteristics, reliability, appearance, and easy handling.

The wound type common mode choke coil according to the present invention provides the following advantages:

(1) The groove portions formed in the collar portion serves as an excess resin clearance groove during the insulation coating layer sealing process, and controls the burr generation in the periphery of the collar portion.

(2) The groove portions formed in the collar portion and the excess resin flowed therein are covered with the second electrode layer and not exposed, providing a tip shaped coil component and finished product with good mounting characteristics and a desirable appearance.

(3) As the outer circumference of the coil conductor is covered integrally with the non-magnetic first insulation coating layer, the normal mode impedance component is reduced, improving the common mode characteristics.

(4) As the second insulation coating layer containing magnetic powder is disposed according to the square shape of the collar portion from the concave area between both collar portions to the groove portion of respective collar portions, leak magnetic flux can be reduced by the magnetic shield.

(5) The conductive connection portion is protected by the second insulation coating layer, thereby improving the reliability.

REFERENCE NUMERALS

1 Winding core portion
2,3 Collar portions
4*a* to 4*d* Outer circumference of collar sections
5, 15, 19 Groove portions
6 End face of collar section
7*a*, 7*b* First electrode layers of collar portion 2
8*a*, 8*b* First electrode layers of collar portion 3
10, 10' Magnetic core
12*a*, 12*b* Coil conductors
13 Leading portion
24*a* Excess resin
17*a*, 17*b* Second electrode layers of collar portion 2
18*a*, 18*b* Second electrode layers of collar portion 3
23, 33 First insulation coating layers
24, 34 Second insulation coating layers
20, 30, 40, 50, 60, 70 wound type common mode choke coils
E Conductive connection portion

What is claimed is:

1. A wound type common mode choke coil, comprising:

a magnetic core having a square collar portion respectively at both ends of a winding core and a groove portion around the circumferential surface of each collar portion from said winding core side to the end face side of the collar portion;

a plurality of first electrode layers disposed respectively separately at least around the circumferential surface of each collar potion of said magnetic core;

a pair of coil conductors wound around the winding core portion of said magnetic core and whose respective terminals are conductively connected to said first electrode layer of said collar portion;

a non-magnetic first insulation coating layer disposed so as to integrally coat the outer circumference of the pair of coil conductors wound around the winding core portion of said magnetic core;

a second insulation coating layer armored to the whole outer circumference of said first insulation coating layer containing magnetic powder of said winding core portion, and disposed according to the square shape of the collar portion from a concave area between both collar portions to the groove portion of each collar portion of said magnetic core; and a second electrode layer coating from the groove portion on which said second insulation coating layer of the circumferential surface of each collar portion of said magnetic core is disposed to said first electrode layer.

2. The wound type common mode choke coil according to claim 1, wherein the conductive connection portion of respective terminals of said pair of coil conductors and said first electrode layer is disposed in the groove portion on the circumferential surface of said collar portion.

3. The wound type common mode choke coil according to claim 2, wherein said first insulation coating layer coats from the outer circumference of the pair of coil conductors wound around the winding core portion of said magnetic core to the conductive connection portion of respective terminals of said coil conductors and said first electrode layer.

4. The wound type common mode choke coil according to claim 1, wherein said first insulation coating layer coats from the outer circumference of the pair of coil conductors wound around the winding core portion of said magnetic core to the conductive connection portion of respective terminals of said coil conductors and said first electrode layer.

* * * * *